US008581923B2

(12) United States Patent
Kerofsky

(10) Patent No.: US 8,581,923 B2
(45) Date of Patent: Nov. 12, 2013

(54) TEMPORAL COLOR LIQUID CRYSTAL DISPLAY

(75) Inventor: Louis Joseph Kerofsky, Camas, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 744 days.

(21) Appl. No.: 12/587,418

(22) Filed: Oct. 7, 2009

(65) Prior Publication Data

US 2011/0080423 A1 Apr. 7, 2011

(51) Int. Cl.
*G09G 5/02* (2006.01)

(52) U.S. Cl.
CPC ..... *G09G 5/02* (2013.01); *G09G 2320/0666* (2013.01); *G09G 2340/06* (2013.01)
USPC ..... 345/593; 345/589; 345/590; 345/591

(58) Field of Classification Search
CPC ..... G09G 5/02
USPC ..... 345/593, 589, 590, 591
See application file for complete search history.

(56) References Cited

U.S. PATENT DOCUMENTS

| | | | | |
|---|---|---|---|---|
| 5,093,652 | A * | 3/1992 | Bull et al. | 345/592 |
| 7,001,058 | B2 * | 2/2006 | Inditsky | 362/610 |
| 7,233,310 | B2 * | 6/2007 | Lazaridis et al. | 345/102 |
| 7,338,197 | B2 * | 3/2008 | Inditsky | 362/615 |
| 7,380,962 | B2 * | 6/2008 | Chaves et al. | 362/293 |
| 7,430,022 | B2 * | 9/2008 | Hekstra et al. | 348/743 |
| 7,483,010 | B2 * | 1/2009 | Bai et al. | 345/88 |
| 7,815,358 | B2 * | 10/2010 | Inditsky | 362/615 |
| 8,008,863 | B2 * | 8/2011 | Chiang et al. | 315/102 |
| 2002/0172039 | A1 * | 11/2002 | Inditsky | 362/231 |
| 2005/0012885 | A1 * | 1/2005 | Park | 349/139 |
| 2005/0035940 | A1 * | 2/2005 | Lazaridis et al. | 345/102 |
| 2006/0077690 | A1 * | 4/2006 | Inditsky | 362/615 |
| 2006/0132405 | A1 * | 6/2006 | Bai et al. | 345/88 |
| 2006/0239006 | A1 * | 10/2006 | Chaves et al. | 362/294 |
| 2007/0070024 | A1 * | 3/2007 | Araki et al. | 345/102 |
| 2007/0146509 | A1 * | 6/2007 | Hekstra et al. | 348/253 |
| 2008/0042966 | A1 * | 2/2008 | Lazaridis et al. | 345/102 |
| 2008/0088566 | A1 * | 4/2008 | Chiang et al. | 345/100 |
| 2008/0094541 | A1 * | 4/2008 | Ma et al. | 349/69 |
| 2008/0129681 | A1 * | 6/2008 | Hagood et al. | 345/109 |
| 2008/0151576 | A1 * | 6/2008 | Inditsky | 362/615 |
| 2008/0204619 | A1 * | 8/2008 | Saitou et al. | 349/43 |
| 2009/0066623 | A1 * | 3/2009 | Ma et al. | 345/89 |
| 2009/0102854 | A1 * | 4/2009 | Lai et al. | 345/589 |
| 2009/0244048 | A1 * | 10/2009 | Yamanaka | 345/212 |
| 2009/0259473 | A1 * | 10/2009 | Chang et al. | 704/260 |
| 2010/0002027 | A1 * | 1/2010 | Krijn et al. | 345/694 |
| 2010/0039362 | A1 * | 2/2010 | Chien et al. | 345/98 |
| 2010/0039425 | A1 * | 2/2010 | Chen et al. | 345/214 |
| 2010/0165013 | A1 * | 7/2010 | Yamamoto et al. | 345/692 |
| 2011/0096084 | A1 * | 4/2011 | Hu et al. | 345/589 |

FOREIGN PATENT DOCUMENTS

| | | |
|---|---|---|
| JP | 2006356072 | 7/2008 |
| WO | WO 2010097018 A1 * | 9/2010 |

OTHER PUBLICATIONS

International Search Report, PCT/JP2010/067325, filed Sep. 28, 2010, 4 pgs.

* cited by examiner

*Primary Examiner* — Javid A Amini
(74) *Attorney, Agent, or Firm* — Chernoff Vilhauer McClung & Stenzel, LLP

(57) ABSTRACT

A temporal based system for reducing the color artifacts of a field sequential color based liquid crystal display.

18 Claims, 10 Drawing Sheets

TEMPORAL COLOR LIQUID CRYSTAL DISPLAY

CROSS-REFERENCE TO RELATED APPLICATIONS

Not applicable.

BACKGROUND OF THE INVENTION

Displays may use different image presentation techniques to produce a color image. Two general types of image presentation techniques include color matrix displays and field sequential color displays.

A color matrix display generates a color image by using a mosaic of individual color primaries. The color matrix display technique relies upon the human visual system (HVS) to spatially low pass filter the resulting mosaic image thereby mixing the primaries to achieve a full color display. In liquid crystal displays (LCDs), the color matrix is typically implemented using a color filter array. The color filter array (CFA) typically includes a patterned array of different primary color filters is placed over a display. Each of the filters only passes a limited respective spectrum of light to synthesize color primary elements. An image is generated by decomposing the image into the primaries of the CFA. The image components are then sent to the corresponding CFA components. The full color image is seen by the HVS following the visual system blending of the CFA primary images. Various CFA and backlight configurations have been used but suffer from two fundamental drawbacks. A first fundamental drawback is that energy is wasted by the light removed by the CFA elements to generate primary colors. A typical RGB primary decomposition may lose as much as ⅔ of the energy from the backlight in this filtering operation, as illustrated in FIG. 1. This reduced efficiency will result in either reduced display brightness at a given backlight power or an increase in backlight power required to achieve a specified brightness. Attempts to use an additional white primary sacrifices the display color gamut for improved display brightness and/or power efficiency. A second fundamental drawback of the CFA technique is the expense of the CFA, and additional manufacturing processes to lay down and accurately align the CFA on the display surface.

A field sequential color (FSC) display synthesizes color using a temporal mix of primaries rather than a spatial mixing of primaries, as with the CFA technique previously described. Temporal primaries are selected, such as red, green, and blue, and the image to be displayed is decomposed into the temporal primaries. The decomposition of a full color image, such as that shown in FIG. 2, into multiple temporal primaries is illustrated in FIG. 3. The full color image is displayed by temporally presenting the different individual primary images rapidly in succession. One example of FSC displays are displays that incorporate Digital Light Processing technology by Texas Instruments.

One of the principal drawbacks of the traditional FSC displays is color breakup caused by relative motion between the viewer's eye and the display. In other words, the individual primary colors (e.g., red, green, blue) are perceived separately at the edges of moving objects. The mis-registration of the color planes is due to horizontal eye motion and the display of the primary fields at temporally spaced apart times. The eye motion and different display times combine to introduce a shift of the primary images on the viewer's retina, and also result in color fringing around text. As a result, the temporal average used by the display to generate a color is disrupted causing annoying artifacts generally known as color break up.

One technique to reduce color break up is to increase the frame rate, such as from 60 Hz to 120 Hz. The increased refresh rate can reduce color break up at the expense of increased computational complexity. The increased refresh rate is also problematic for an LCD due to the relatively slow response time of the liquid crystal material. Increased color cross talk tends to result from the relatively slow liquid crystal response time thereby reducing the color gamut. Another technique to reduce color break up is to include an additional desaturated primary, such as white. The additional desaturated primary may reduce color breakup when the image content can be expressed primarily using the additional desaturated primary. In general, when image energy can be concentrated to a single primary, only one of the terms in the temporal sum is nonzero and hence there is no artifact caused by relative motion of the additional color planes. The problem arises in selecting an additional primary to match the image content. In traditional cases such as the digital light valve by Texas Instruments, the additional primary is selected at manufacture time based on expected typical content. When image content agrees with this selection color break up is reduced. When image content differs from this assumption, color break up is not effectively reduced.

Single viewer color breakup reduction techniques interactively measure the actual eye motion. The measured eye motion is used to compute an image which compensates for the difference in temporal presentation of colors. The requirement to measure the eye motion effectively limits this to applications having a single viewer in a carefully controlled position, such as a heads up display in an aircraft.

Field sequential based frame rate conversion has been used to generate fields which follow the motion of an object in the video content. In addition to the significant complexity and inevitable inaccuracy of motion estimation, the underlying assumption that the viewers' are tracking the motion of every pixel in the video is impossible to hold for a complex image scene i.e. explosion or small object motion which is not tracked and/or multiple viewers.

A temporal average of primaries to represent image color may be based upon selecting the primaries based upon image content. More specifically, one FSC technique represents a color image as a temporal sum of primary components. The LCD structure includes using a spatial grid of active RGB backlights and a color filter free LCD. The temporal primary is the product of the colored backlight and the color less LCD layer. Color break up artifacts are reduced by adapting the backlight, hence temporal primaries, locally to the image content. Additional primaries are used to refine the image color. Unfortunately, a significant limitation is the resulting computational complexity of incorporating an active spatial backlight array.

DETAILED DESCRIPTION OF THE PREFERRED EMBODIMENTS

Figure 1:
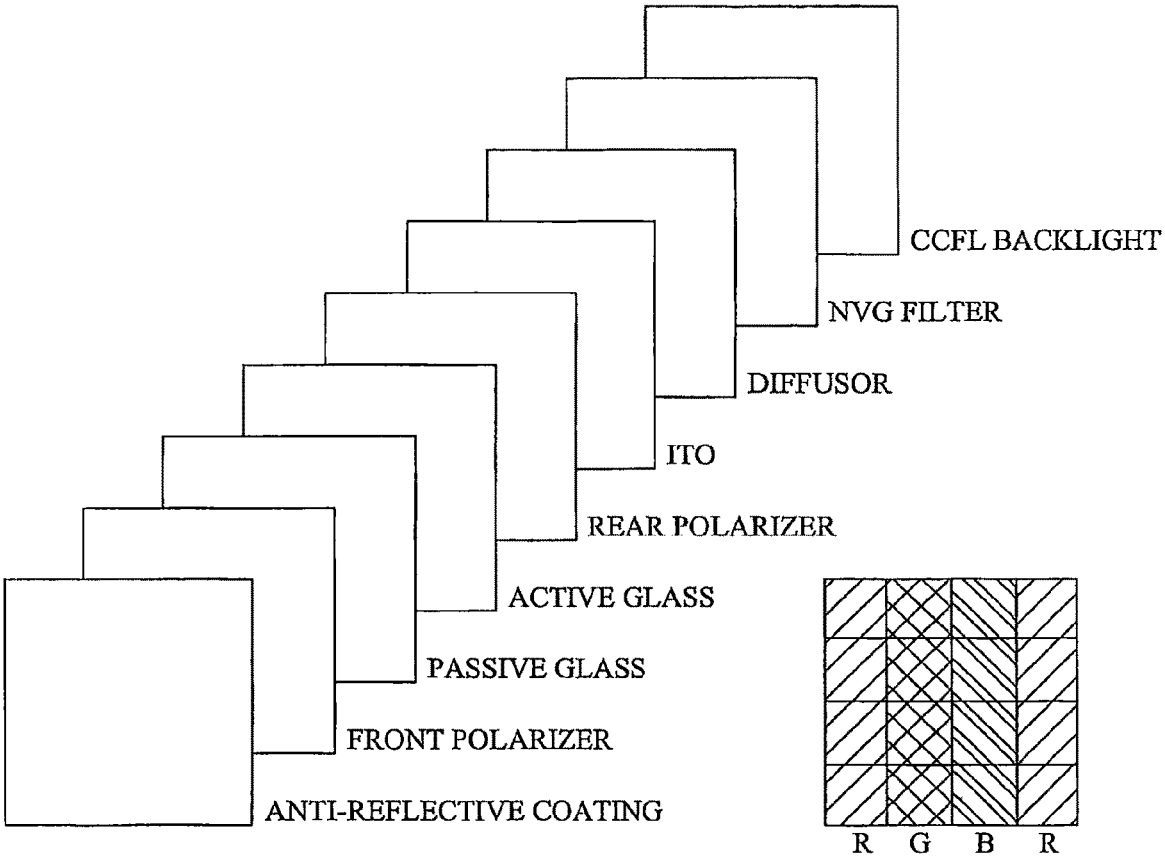
FIG. 1 illustrates a LCD color filter array.
Figure 2:
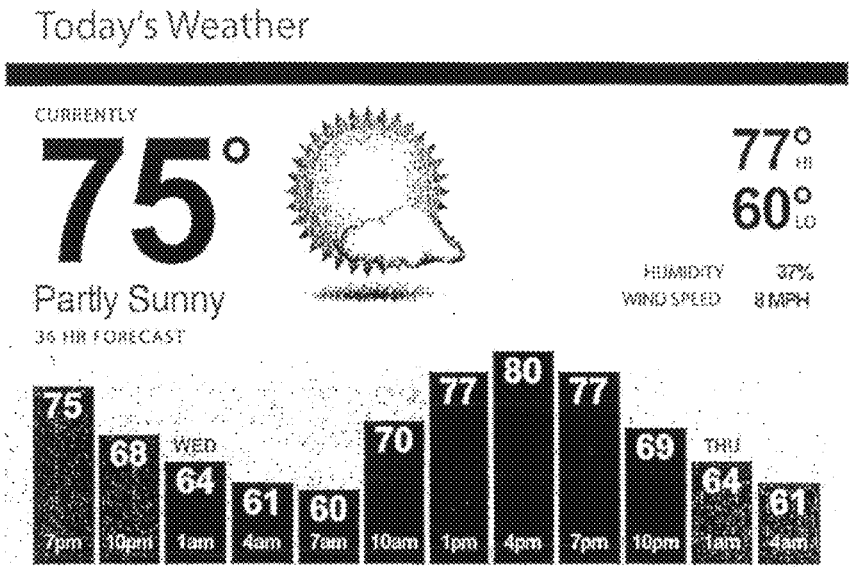
FIG. 2 illustrates a full color image.
Figure 3:
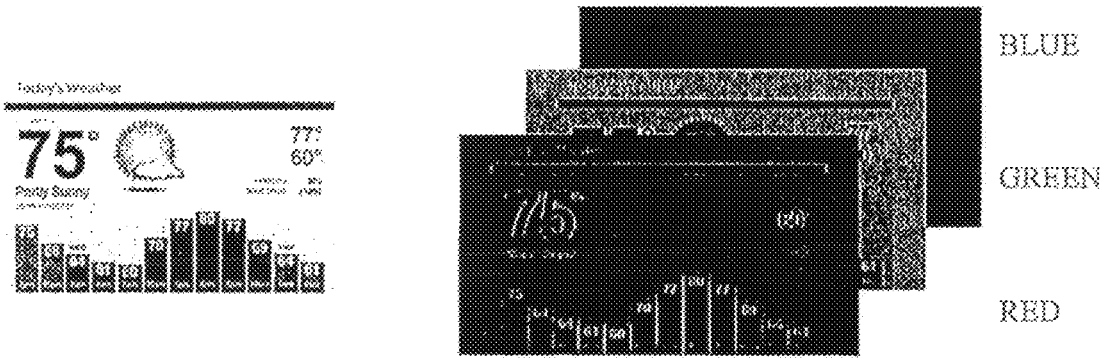
FIG. 3 illustrates field sequential color decomposition.
Figure 4:
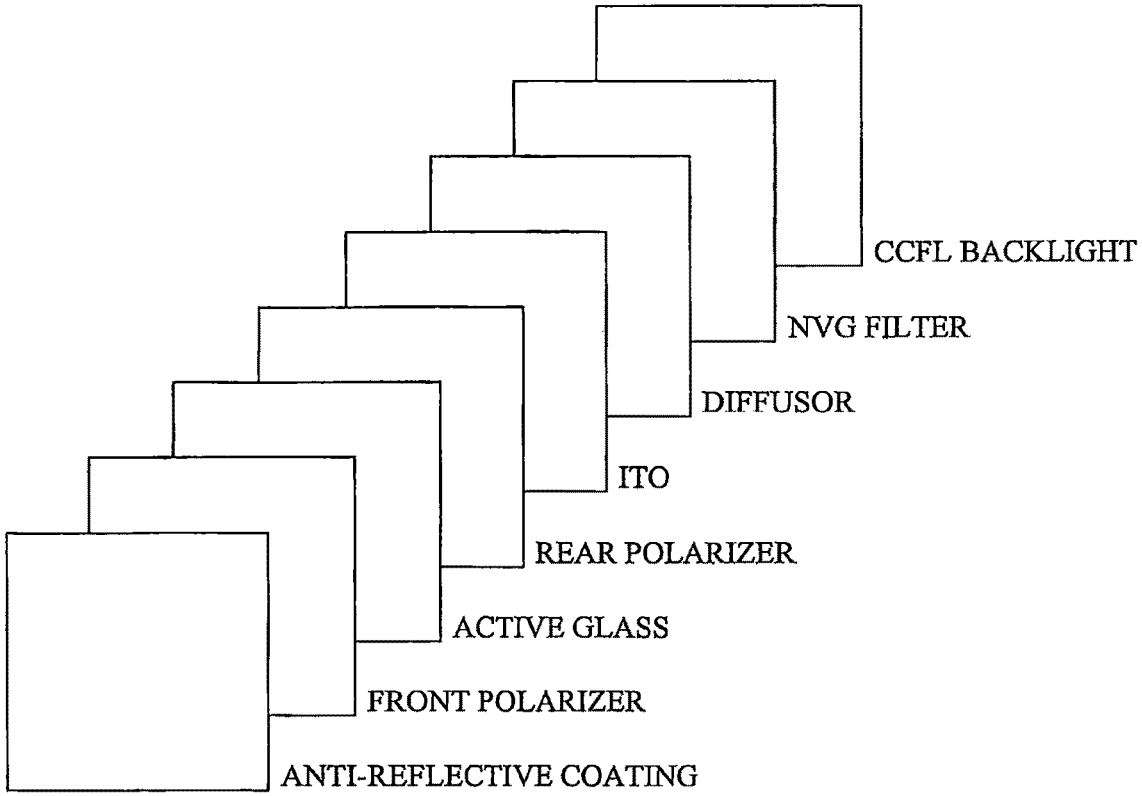
FIG. 4 illustrates field sequential color without a color filter array.

Referring to FIG. 4, a preferred LCD structure does not include a multi-color filter array. Without having a multi-colored filter array, the light provided by the backlight is not as substantially attenuated by the optical stack of the LCD display. This provides an increase in the potential power efficiency of the device and accordingly the display may operate with a substantially dimmer backlight while still providing the desired illumination to the viewer.

Figure 5:
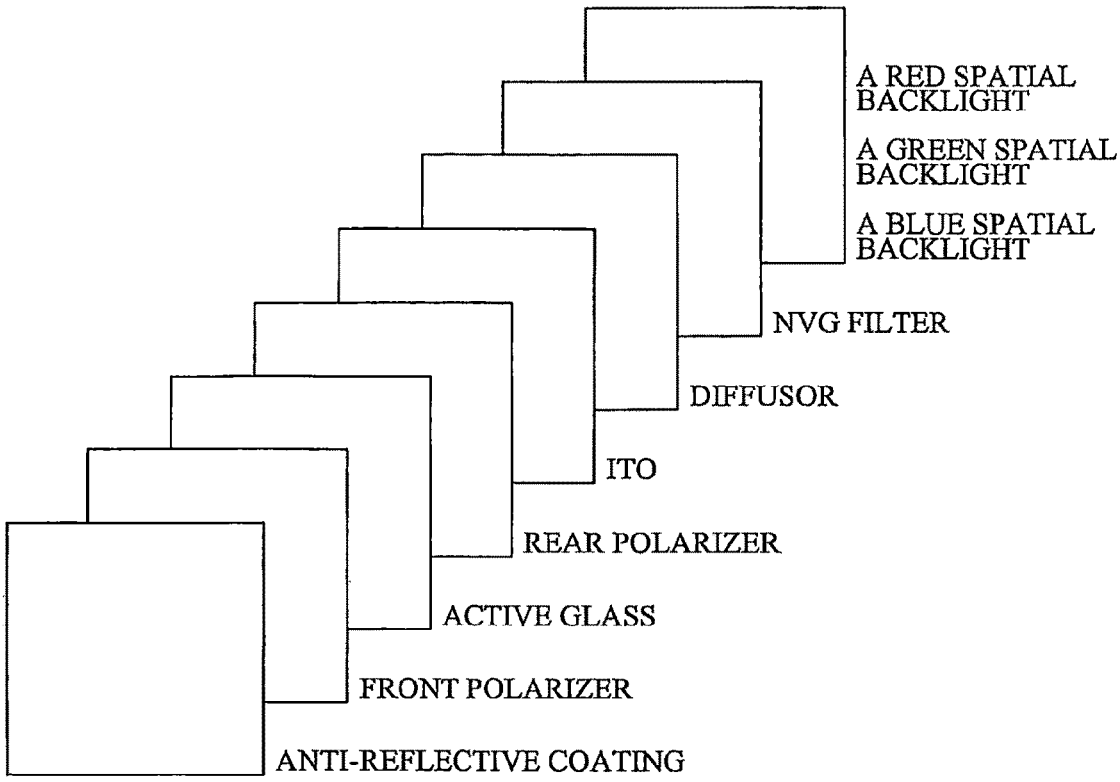
FIG. 5 illustrates field sequential with multi-colored backlight.
Figure 6:
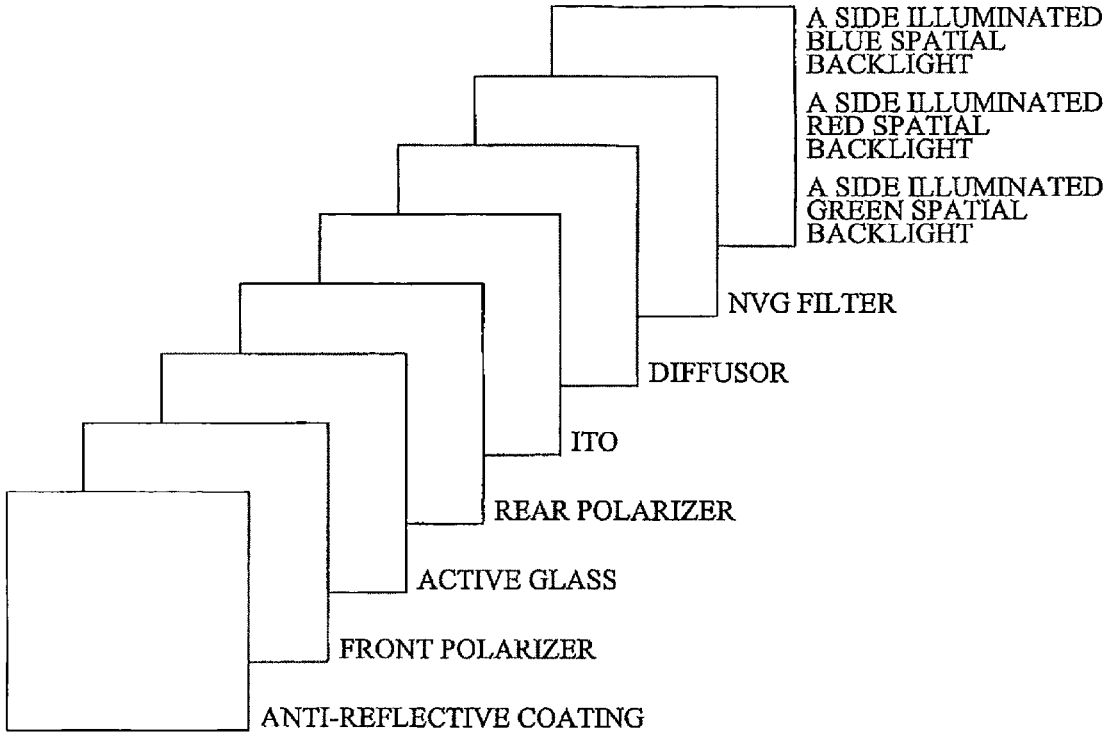
FIG. 6 illustrates field sequential with light emitting diode based backlight.

To provide a full color LCD display without the color filter array (CFA), a backlight assembly should be provided that temporally provides the desired primary colors in a sequential manner. Each of the primaries should be temporally provided to the entire backlight (or substantially all of) in a uniform manner (or substantially uniform). Referring to FIG. 5, in the case of a red, a green, and a blue backlight positioned behind the liquid crystal material, a uniform red illumination may be provided to the entire backlight, followed by a uniform blue illumination being provided to the entire backlight, followed by a uniform green illumination being provided to the entire backlight. In some cases, the backlight or combination of separately controllable backlights may be provided across the back of the display in a manner similar to a single cold cathode florescent light. Referring to FIG. 6, in other cases, the backlight may be provided by a set of multi-colored light emitting elements (e.g., light emitting diodes) arranged to provide light from the side of the display that is reflected forward by the display. The light emitting elements may be a set of red light emitting elements, a set of green light emitting elements, and a set of blue light emitting elements, where each set effectively acts together to provide a uniform illumination to the display.

One example where power efficiency and relatively low cost is important is large scale digital signage. In the case of digital signage, eye motion may be the result of scrolling text or eye motion while reading. The operation of a signage display has aspects which differ from an entertainment display, i.e. television content. Most notable aspects are the characteristics of content shown on a digital sign, which include for example, a large percentage of still content, some scrolling text, some graphics content, and limited video viewing time.

Figure 7:
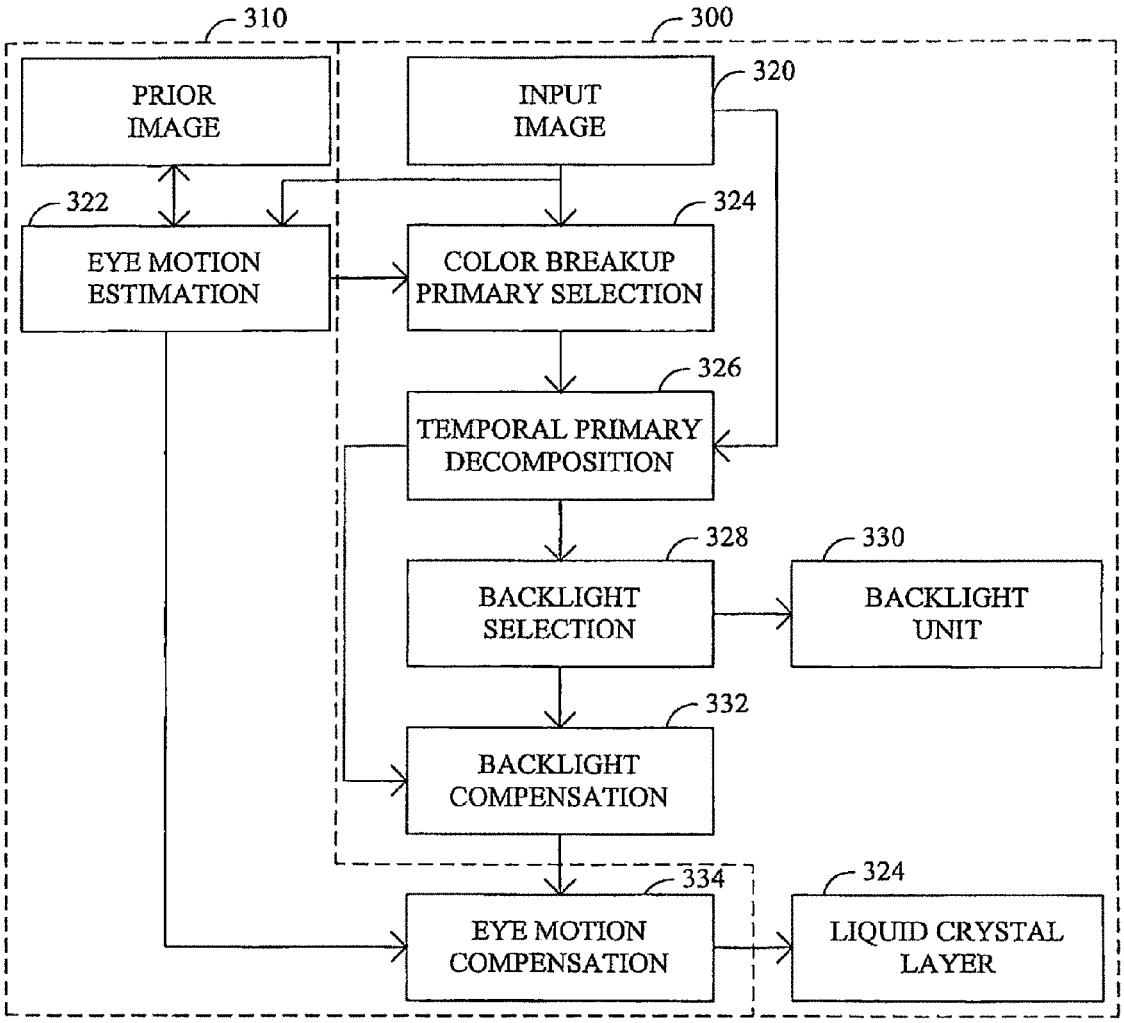
FIG. 7 illustrates a color breakup reduction technique.

Referring to FIG. 7, a block diagram of an adaptive temporal primary display with eye motion compensation to reduce color break up may use adaptive global temporal primaries for the backlight 300 and/or use eye motion compensation 310. The color break up artifacts are reduced preferably by both the decomposition into temporal primaries 300 and the explicit compensation for estimated eye motion 310. A scrolling text detector may be used to control the compensation of color break up for scrolling text.

Given an input image 320, an estimate of eye motion 322 is computed based upon the image content. The eye motion estimate 322 and the input image 320 are used to select a single primary 324 which reduces global color break up, preferably in the regions without eye motion. The input image 320 is then decomposed 326 into temporal primaries consisting of the selected primary color 324 reducing primary and three additional primaries which span the image gamut, i.e. RGB. For each primary image, the backlight 328 is computed using the corresponding primary. The selected backlight 328 is used to drive the backlight unit 330 and used as input to the backlight compensation 332. The primary image and the selected backlight are used to compute an image which compensates for backlight dimming. The concentration of image energy into few primaries tends to reduce color break up as an image pixel is represented with information from only a single subframe time period which is insensitive to relative viewer eye motion. An additional color break up reduction method is to compensate 334 the temporal primary images based on an estimate of viewer eye motion 332 and the temporal presentation frequency and order. The compensated image for each primary is sent to the LC layer 324 of the display.

The signage example has several characteristics which allow global temporal primaries to effectively reduce color break up. Typically signage has a large static area, scrolling text provides an anchor for eye tracking allowing accurate estimation of eye tracking velocity, and the ability to control the content as the content is typically generated by a controlling computer.

Figure 8:
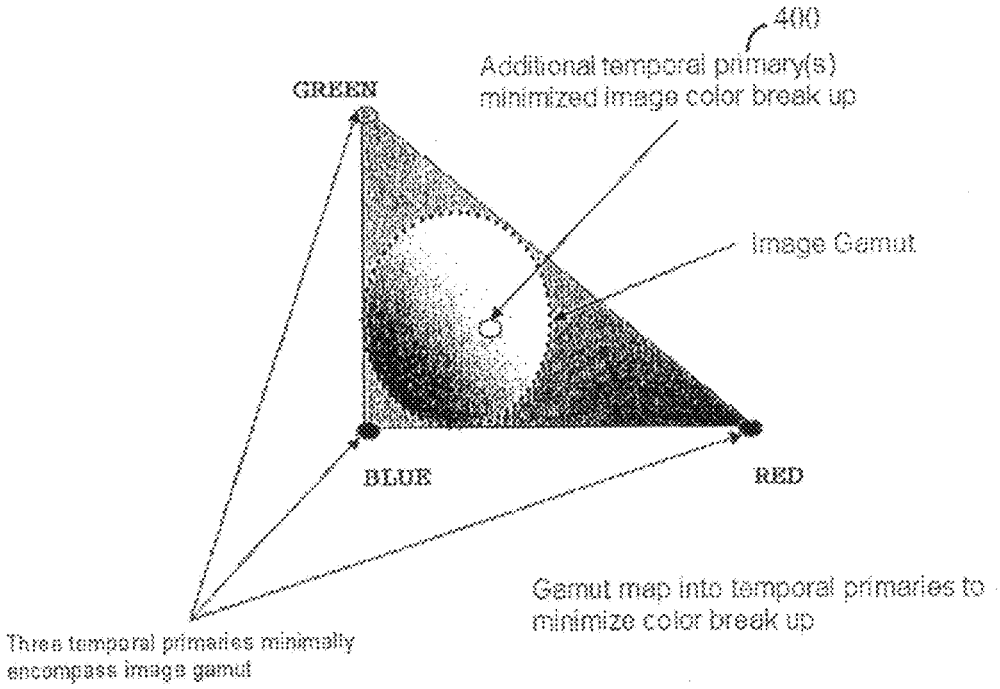
FIG. 8 illustrates global temporal primary selection.

As previously noted, one color break up reduction technique includes using four (or any suitable number) of temporal primaries. The selection of the temporal primaries are adaptable to the image content rather than being fixed. An illustration of the use of adaptive primaries is illustrated in FIG. 8. The first temporal primary 400 may be selected to minimize color breakup by concentrating a significant part of the image energy in this first primary. This is effective in reducing color break up for content over large areas composed of generally uniform color. For example, if black text is placed over a white background, a white primary would minimize color breakup during reading as the image is entirely in a single sub-frame time period of an image frame. The three remaining primaries are selected to span a substantial part of the image color gamut. For example, a default mode may be to use red, green, and blue primaries. Other primaries may likewise be selected, as desired. In the absence of eye motion the image will be displayed in color without color breakup. For each primary, the backlight brightness is preferably selected so that the LCD is maximally (or substantially) open so that power consumption is reduced and the LCD transitions are reduced, and thus a reduction of potential color cross talk.

Figure 9:
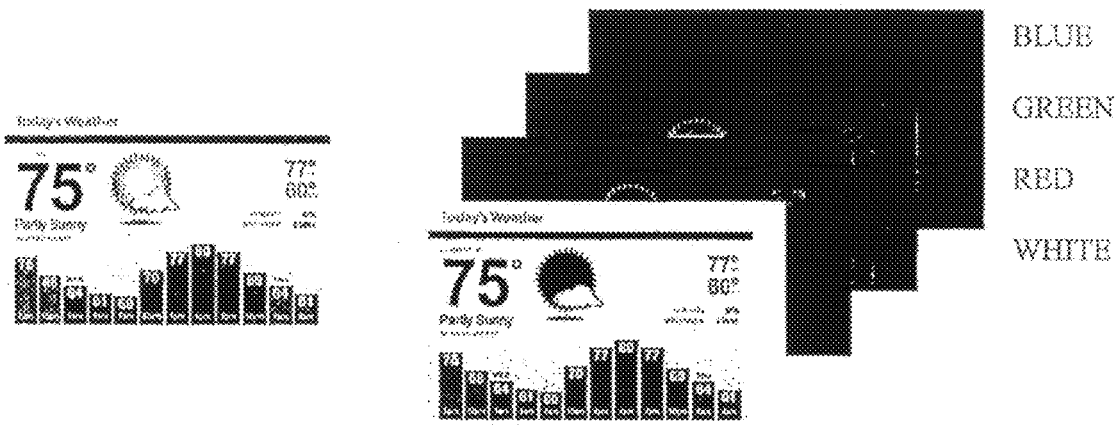
FIG. 9 illustrates a four primary selection field sequential color technique.

Following the primary selection, the input image may be decomposed into multiple primaries. The selection may be made based on the desire of reducing color break up artifacts. Among the possible redundant representations, the representation which places the most energy into the color break up reduction primary is preferred. An illustration of decomposing an image into four temporal primaries, white, red, green, and blue, is shown in FIG. 9.

As previously noted, another color break up reduction technique uses an estimate of viewer's eye motion to reduce color breakup by compensating the image. If the eye motion is known or can be estimated, the temporal refresh rate and/or order of the temporal primaries may be used to determine the preferred compensation to reduce color breakup due to misregistration of the temporal primaries due to relative eye motion. The system preferably selectively applies compensation to regions of the image where a smooth pursuit eye tracking velocity can be accurately determined. Consider an example frame from a video sequence consisting of scrolling text over a static background. Two eye motions are likely. When view is centered on the static background, the velocity is zero. When the viewer tracks the scrolling text, the eye motion is generally determined by the velocity of the text. The static region of the image is presented to the viewer assuming no eye motion in the static region and the scrolling text region is presented assuming smooth eye tracking of the scrolling text. The estimation of eye motion in motion areas of the image results in a shift of the primary image components to compensative for the anticipated eye motion. When the actual eye motion agrees with the estimate, color breakup is reduced. In areas where eye motion differs from that used for compensation, color breakup is observed and may even be introduced in areas where the uncompensated image would not exhibit color breakup.

The image compensation for estimated eye motion due to the presence of scrolling text may use a scrolling text detector. By way of example, the scrolling text may be confined to the lower 5-10 percent of the image. A constant horizontal eye motion velocity equal to the text velocity maybe assumed in this region of the image and zero eye motion velocity may be assumed outside of this region. The estimated eye motion velocity is used to shift the primary images according to their temporal presentation. For example if the velocity is 12 pixels per frame and four temporal primaries are used, the image should be shifted by 3 pixels each temporal primary period. Thus the images would shift by 0, 3, 6, and 9 pixels respectively.

As it may be observed, when using a scrolling text detector other region based motion detection, the entire region is identified as moving in a uniform manner. While parts of the region are moving in a uniform manner, there are other parts of the region that are not likewise moving and thus would otherwise be classified as static. A viewer's eye will have a single motion will move according to the dominant motion. Accordingly, the motion based compensation will be applied to moving pixels and non-moving pixels alike.

In a similar manner, when identifying a region as not including motion, the entire region is identified as static in a uniform manner. While parts of the region may be moving in some manner, there are other parts of the region that are not likewise moving and thus are classified as static. However, the viewer's eye will not track the motion of a few isolated image pixels and it is desirable to classify the entire region, including moving and non-moving pixels, as static in a uniform manner. Accordingly, the non-motion based compensation will be applied to the moving pixels and non-moving pixels alike.

Figure 10:
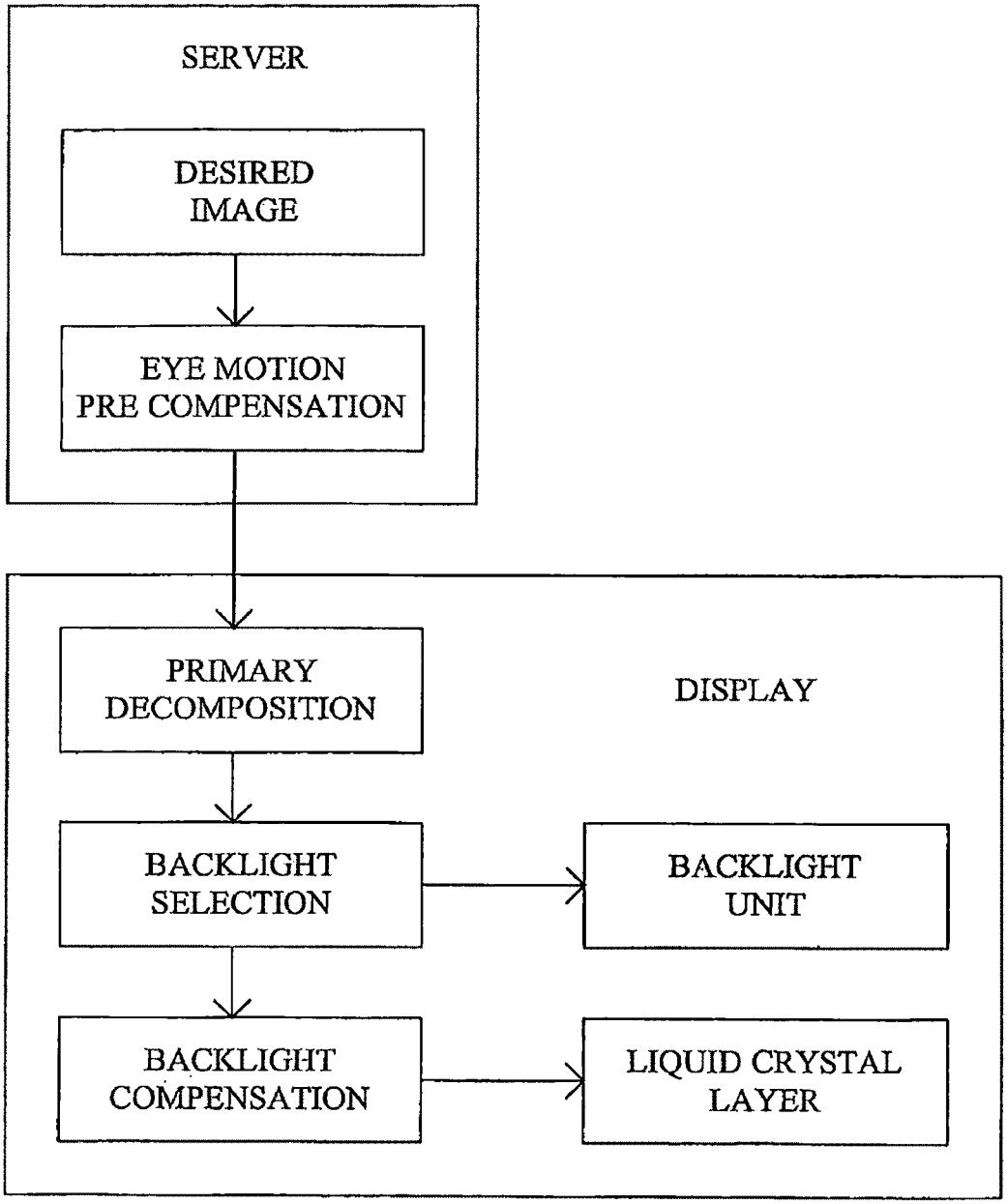
FIG. 10 illustrates a server based color breakup reduction technique.

Referring to FIG. 10, the system may also compensate the input source for anticipated eye motion based color breakup. This is beneficial in that a server may be aware of the motion in image content such as scrolling text. This eliminates the need to detect such motion in the display, thus reducing complexity. For pre-compensation, the server may know characteristics of the display, such as the temporal primaries used and their order of presentation. This technique may also be used with fixed temporal primary selection and order. When using this technique, eye motion compensation in the display should be disabled to avoid attempting to correct twice for eye motion.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method for modifying an image to be displayed on a liquid crystal display comprising:

(a) selecting, automatically and without user input, a first color based upon the content of said image and illuminating a backlight assembly with a substantially uniform backlight over the entire said display over a first sub-frame period at said selected first color;

(b) illuminating a backlight assembly with a substantially uniform backlight over the entire said display during each of at least three additional sub-frame time periods of a frame, wherein said light passes through said display free from passing through a color filter array;

(c) selecting a different color for illumination during each of said at least three additional sub-frame time periods of said frame, wherein one of said colors is said selected first color light source.

2. The method of claim 1 wherein said illumination is uniform during each sub-frame time period.

3. The method of claim 1 wherein said different colors include red during one of said additional sub-frame time periods, blue during another one of said additional sub-frame time periods, and green during another one of said additional sub-frame time periods.

4. The method of claim 1 wherein said first color is a combination of at least two of red, blue, and green colors.

5. The method of claim 1 wherein said backlight assembly includes a red light source.

6. The method of claim 5 wherein said backlight assembly includes a blue light source.

7. The method of claim 6 wherein said backlight assembly includes a green light source.

8. The method of claim 1 wherein said backlight assembly includes a plurality of light emitting diodes.

9. The method of claim 8 wherein said light emitting diodes direct light into the display from the periphery thereof.

10. The method of claim 1 wherein said selection of said first color is based up reducing color breakup.

11. The method of claim 10 wherein said image is temporally decomposed based upon said selected first color.

12. The method of claim 11 wherein said backlight assembly is temporally illuminated based upon said temporal decomposition.

13. The method of claim 12 wherein said selection of said first color is based upon an estimation of eye motion.

14. The method of claim 13 wherein said temporally decomposed image is modified based upon said estimation.

15. The method of claim 14 wherein said modified image is temporally displayed on said display.

16. The method of claim 1 wherein a region of said image is determined to have uniform motion independent of whether all pixels within said region have such uniform motion.

17. The method of claim 16 wherein said region of said image is compensated based upon an estimation of eye motion.

18. The method of claim 17 wherein said another region of said image is not compensated based upon said estimation of eye motion.

* * * * *